US008596247B2

(12) United States Patent
Tower et al.

(10) Patent No.: US 8,596,247 B2
(45) Date of Patent: Dec. 3, 2013

(54) FUEL DELIVERY ASSEMBLY

(75) Inventors: Benjamin Ray Tower, Varna, IL (US); Craig Phillip Hittle, Peoria, IL (US); Michael Patrick Harmon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 676 days.

(21) Appl. No.: 12/835,144

(22) Filed: Jul. 13, 2010

(65) Prior Publication Data

US 2012/0012083 A1 Jan. 19, 2012

(51) Int. Cl.
*F02M 61/14* (2006.01)
*F02M 61/16* (2006.01)

(52) U.S. Cl.
USPC ..... 123/470; 123/468

(58) Field of Classification Search
USPC ..... 123/468, 469, 470, 456, 447; 239/88, 239/533.2; 285/382.5, 286.1, 286.2; 403/334
See application file for complete search history.

(56) References Cited

U.S. PATENT DOCUMENTS

| | | | | |
|---|---|---|---|---|
| 1,934,580 | A * | 11/1933 | Woolson | 239/88 |
| 2,035,203 | A * | 3/1936 | Smith | 239/5 |
| 3,845,748 | A | 11/1974 | Eisenberg | |
| 5,617,828 | A | 4/1997 | Kuegel et al. | |
| 5,724,946 | A | 3/1998 | Franchitto | |
| 5,775,303 | A | 7/1998 | Sweetland et al. | |
| 6,234,413 | B1 | 5/2001 | Greaney | |
| 6,237,571 | B1 | 5/2001 | Harrison | |
| 6,619,264 | B2 | 9/2003 | Bolsover et al. | |
| 6,820,315 | B1 | 11/2004 | Hans et al. | |
| 7,107,969 | B2 | 9/2006 | Norcutt et al. | |
| 7,658,179 | B2 | 2/2010 | Bock et al. | |
| 7,958,870 | B2 * | 6/2011 | Bonfigli et al. | 123/470 |
| 2007/0089712 | A1 | 4/2007 | Spinnler | |
| 2009/0107462 | A1 | 4/2009 | Gibson et al. | |
| 2010/0077971 | A1 | 4/2010 | Venkataraghavan et al. | |
| 2010/0077994 | A1 | 4/2010 | Manubolu et al. | |

FOREIGN PATENT DOCUMENTS

| | | |
|---|---|---|
| WO | 9725530 | 7/1997 |

* cited by examiner

*Primary Examiner* — Mahmoud Gimie
(74) *Attorney, Agent, or Firm* — Finnegan, Henderson, Farabow, Garrett & Dunner LLP

(57) ABSTRACT

A fuel delivery assembly for delivering a flow of fuel to a fuel injector includes a securing member including a securing member opening extending through the securing member such that the securing member is generally cylindrical. The securing member opening includes an inner surface that includes a securing member projection. The fuel delivery assembly also includes a quill tube including a quill tube opening extending through the quill tube such that the quill tube is generally cylindrical. The quill tube opening is configured to receive the flow of fuel and direct the flow of fuel to the fuel injector. The quill tube includes an outer surface that includes a quill tube projection. The securing member opening is configured to receive at least a portion of the quill tube, and the securing member projection and the quill tube projection are configured to engage in an interference fit.

17 Claims, 6 Drawing Sheets

FUEL DELIVERY ASSEMBLY

TECHNICAL FIELD

The present disclosure relates generally to a fuel delivery assembly, and more particularly, to a fuel delivery assembly for an engine.

BACKGROUND

Fuel systems typically employ multiple fuel injectors to inject high pressure fuel into respective combustion chambers of an engine. The high pressure fuel is supplied to the fuel injectors via a common rail located adjacent to the engine, and individual fuel lines connect the common rail to the fuel injectors.

In some fuel systems, quills or other tubular connectors are provided to supply the high pressure fuel from the common rail to the respective fuel injectors. One type of tubular connector is described in U.S. Pat. No. 6,234,413 (the '413 patent) issued to Greaney. The '413 patent describes a tubular connector that feeds fuel from a high pressure line to a fuel injector. Part of the tubular connector is inserted into the cylinder head of the engine, and part of the tubular connector is exterior to the cylinder head of the engine.

Although the tubular connector of the '413 patent may be capable of supplying high pressure fuel from the common rail to the respective fuel injector, the connection that is exterior to the cylinder head, such as the connection between the fuel line and the end of the tubular connector, may require additional shielding to prevent the leakage of high pressure fuel in certain applications.

The disclosed system is directed to overcoming one or more of the problems set forth above.

SUMMARY

In one aspect, the present disclosure is directed to a fuel delivery assembly for delivering a flow of fuel to a fuel injector. The fuel delivery assembly includes a securing member including a securing member opening extending through the securing member such that the securing member is generally cylindrical. The securing member opening includes an inner surface that includes a securing member projection. The fuel delivery assembly also includes a quill tube including a quill tube opening extending through the quill tube such that the quill tube is generally cylindrical. The quill tube opening is configured to receive the flow of fuel and direct the flow of fuel to the fuel injector. The quill tube includes an outer surface that includes a quill tube projection. The securing member opening is configured to receive at least a portion of the quill tube, and the securing member projection and the quill tube projection are configured to engage in an interference fit.

In another aspect, the present disclosure is directed to a method of assembling a fuel delivery assembly for an engine. The method includes detachably connecting a first subcomponent to a second subcomponent to form a fuel delivery component. A valve member is disposed between the first and second subcomponents. The first and second subcomponents and the valve member are configured to receive a flow of fuel. The first subcomponent is detachably connected to the second subcomponent with an interference fit. The method also includes detachably connecting a securing member to the fuel delivery component with an interference fit, inserting at least a portion of the connected securing member and the fuel delivery component into a bore in a cylinder head of the engine, and detachably connecting the securing member to an inner surface of the bore.

In a further aspect, the present disclosure is directed to an engine including a cylinder head including a bore. The bore includes an inner surface. The engine also includes a generally cylindrical securing member including an outer surface configured to be detachably connected to the inner surface of the bore and a fuel delivery component including an opening extending through the fuel delivery component such that the fuel delivery component is generally cylindrical. The opening is configured to receive a flow of fuel. The securing member is detachably connected to the fuel delivery component. The securing member and the fuel delivery component are configured to be inserted into the bore in the cylinder head such that the entire fuel delivery component is located in the bore when the outer surface of the securing member is connected to the inner surface of the bore. The engine further includes a fuel injector disposed inside the cylinder head and configured to receive the flow of fuel from the fuel delivery component.

DETAILED DESCRIPTION

Reference will now be made in detail to exemplary embodiments of the invention, examples of which are illustrated in the accompanying drawings. Wherever possible, the same reference numbers will be used throughout the drawings to refer to the same or like parts.

Figure 1:
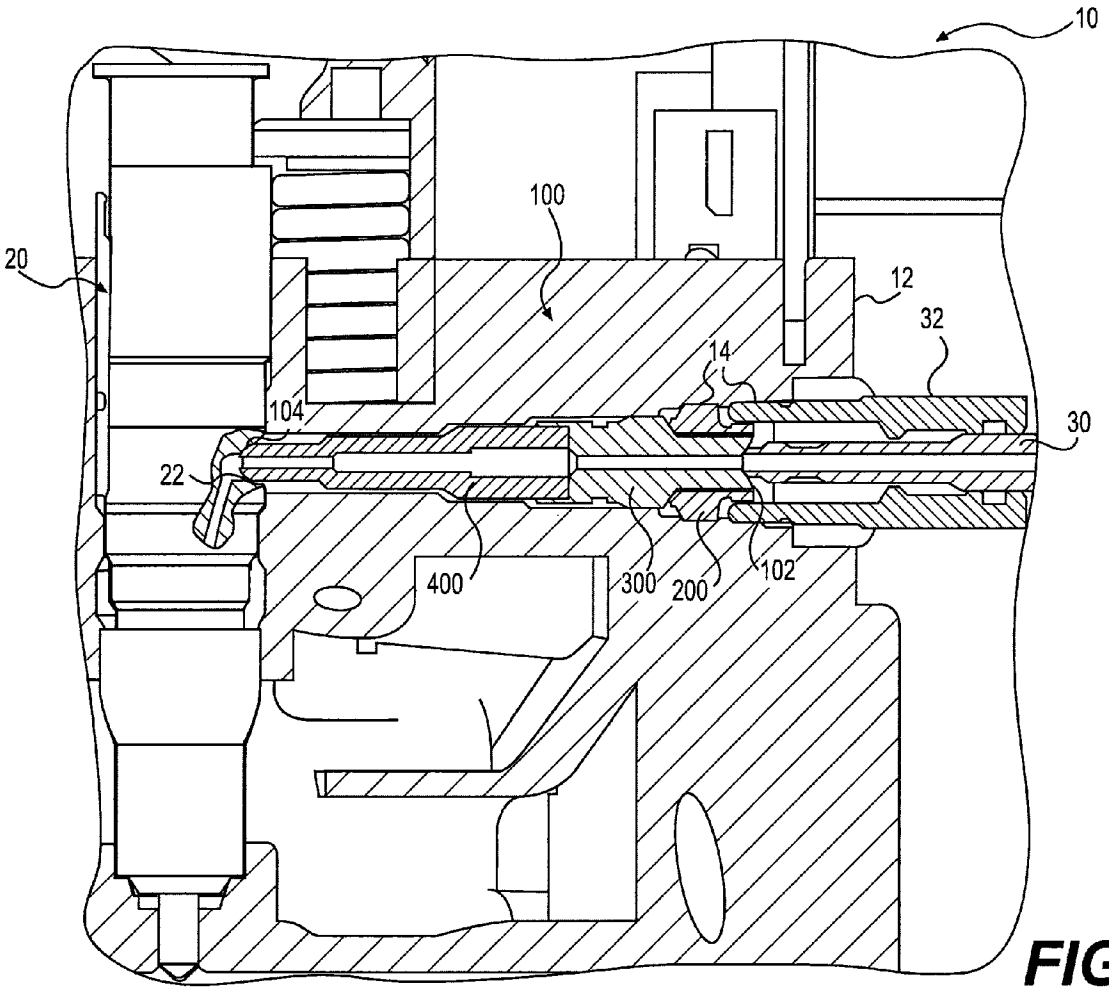
FIG. 1 is a cross sectional view of an engine including a fuel injector, fuel delivery assembly, fuel line, and fuel line connector, according to an exemplary embodiment.

FIG. 1 shows a power source, such as an engine 10, of a machine, according to an exemplary embodiment. The engine 10 may be provided in various types of machines such as, for example, a fixed or mobile machine that performs some type of operation associated with an industry such as mining, construction, farming, transportation, power generation, tree harvesting, forestry, or any other industry known in the art. The engine 10 may be an internal combustion engine or any other engine apparent to one skilled in the art such as, for example, a diesel engine, a gasoline engine, a gaseous fuel powered engine, or any other type of engine apparent to one skilled in the art. The engine 10 may include a cylinder head 12 having one or more cylinders (not shown) formed therein, each with a piston (not shown) in a combustion chamber (not shown) associated therewith as known in the art.

The engine 10 may further include a fuel system. For example, the fuel system may include a fuel tank (not shown), a high pressure pump (not shown), and/or a common rail (not shown). The common rail may supply fuel at a relatively high pressure to one or more fuel injectors 20 disposed in the cylinder head 12, and each fuel injector 20 may be associated with a respective cylinder and configured to inject fuel into the respective cylinder. The fuel injector 20 may be operable to inject an amount of pressurized fuel into the associated combustion chamber in the cylinder head 12 at predetermined times, fuel pressures, and fuel flow rates as known in the art.

In an exemplary embodiment, fuel may be supplied to the fuel injector(s) 20 via a fuel line 30. A connector 32 may connect the fuel line 30 to the cylinder head 12 so that the fuel line 30 may be fluidly connected to a fuel delivery assembly 100 disposed in a bore in the cylinder head 12. High pressure fuel, e.g., from the high pressure pump and/or the common rail, may be supplied to the fuel delivery assembly 100 via the fuel line 30, and the fuel delivery assembly 100 may supply the high pressure fuel to the fuel injector 20.

The fuel delivery assembly 100 includes an inlet end 102 and an outlet end 104. For example, the inlet end 102 may be located toward a proximal end of the fuel delivery assembly 100, and the outlet end 104 may be located toward a distal end of the fuel delivery assembly 100, as shown in FIG. 1. The outlet end 104 of the fuel delivery assembly 100 may be connected to the fuel injector 20 to supply high pressure fuel to the fuel injector 20. For example, as shown in FIG. 1, the outlet end 104 of the fuel delivery assembly 100 may be inserted into an inlet 22 formed in the fuel injector 20. The inlet 22 may be shaped correspondingly (e.g., with a conical or spherical surface) to receive the outlet end 104 (e.g., having a conical or spherical surface) of the fuel delivery assembly 100. The terms "proximal" and "distal" are used herein to refer to the relative positions of the components of an exemplary fuel delivery assembly 100. When used herein, "proximal" refers to a position relatively closer to the exterior of the engine 10 and/or relatively further from the fuel injector 20. In contrast, "distal" refers to a position relatively closer to the interior of the engine 10 and/or relatively closer to the fuel injector 20.

Figure 2:
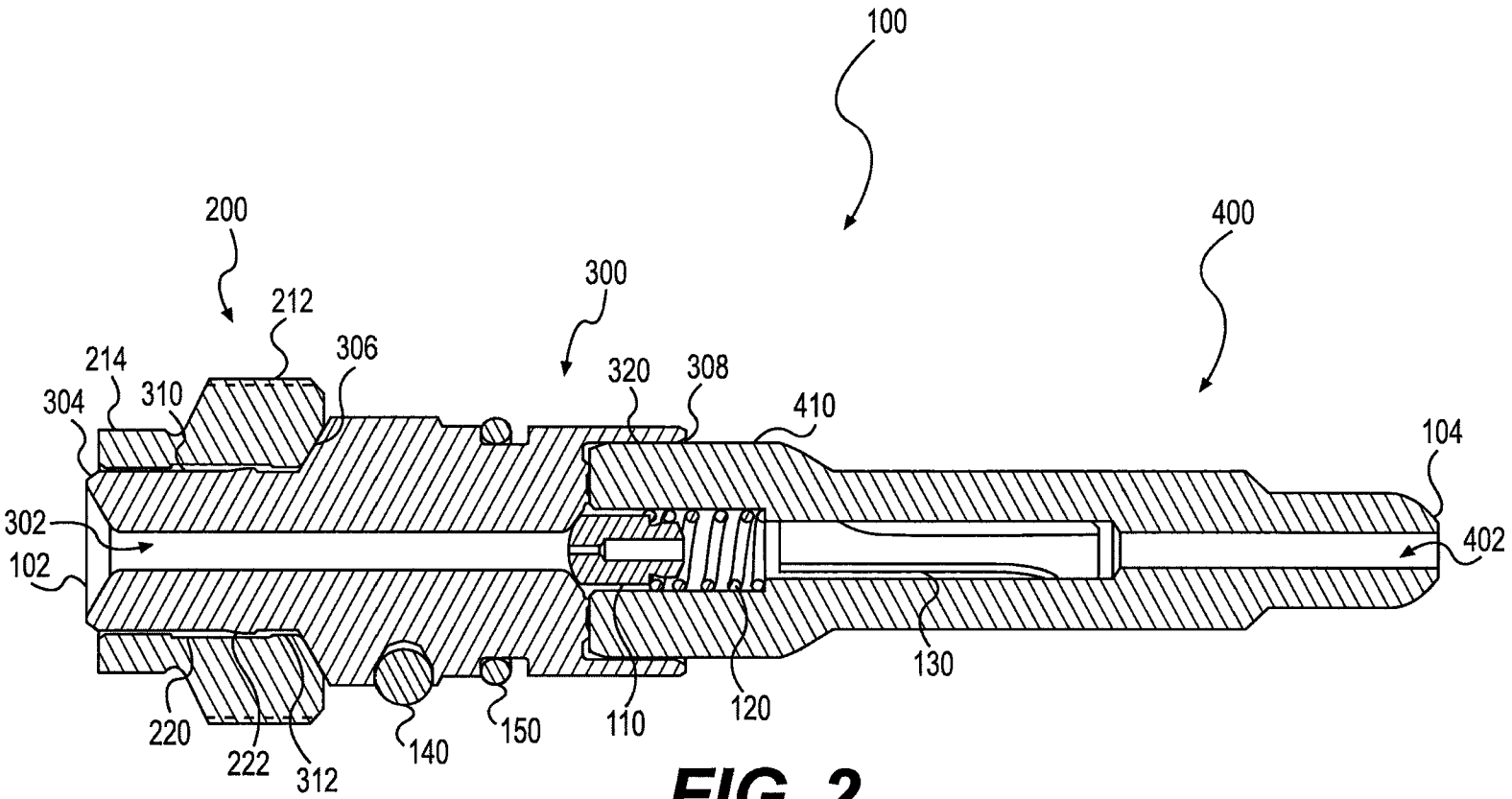
FIG. 2 is a cross sectional view of the fuel delivery assembly of FIG. 1.

FIG. 2 shows an exemplary embodiment of the fuel delivery assembly 100. The fuel delivery assembly 100 may include a quill nut 200 that is detachably connected to a quill tube. The quill tube may include a quill tube proximal component 300 that is detachably connected to a quill tube distal component 400. Alternatively, the quill tube may include a single tubular component, e.g., by integrally forming the quill tube proximal component 300 and the quill tube distal component 400 together or by permanently connecting the quill tube proximal and distal components 300, 400 together.

Figure 3:
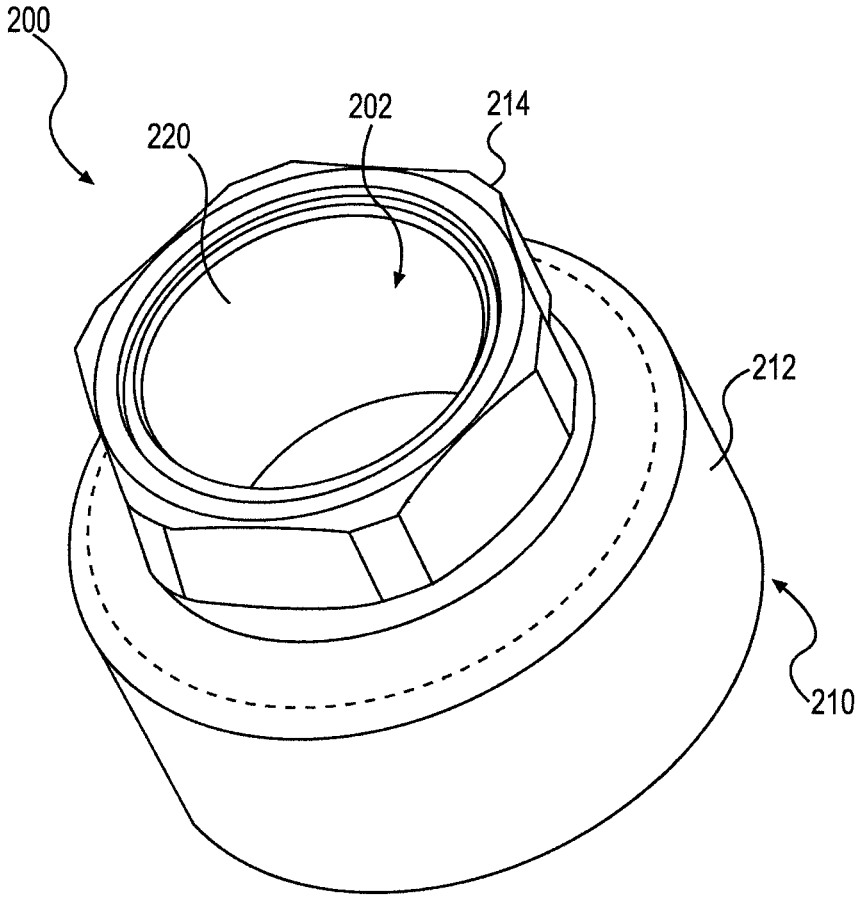
FIG. 3 is a perspective view of a quill nut of the fuel delivery assembly of FIG. 1.

FIG. 3 is a perspective view of the quill nut 200. The quill nut 200 includes an opening 202 extending through the quill nut 200 such that the quill nut 200 is generally cylindrical. The quill nut 200 also includes an outer surface 210, and the outer surface 210 may include a threaded portion 212 and a gripping portion 214 disposed proximal to the threaded surface 212. The threaded portion 212 is configured to engage a corresponding threaded surface 14 (FIG. 1) in the cylinder head 12 to attach the quill nut 200 to the cylinder head 12 when the quill nut 200 is inserted into the cylinder head 12, as shown in FIG. 1. The gripping portion 214 is configured to be gripped by a tool for unscrewing and extracting the quill nut 200 from the cylinder head 12. For example, the gripping portion 214 may include a hex nut feature. A user may use a hex nut socket or other tool to engage the hex nut feature of the gripping portion 214 to remove the quill nut 200 from the cylinder head 12.

As shown in FIG. 2, the quill tube proximal and distal components 300, 400 each include an opening 302, 402 extending through the respective component 300, 400 such that the components 300, 400 are generally cylindrical. The openings 302, 402 are configured to receive the high pressure fuel from the fuel line 30 and to supply the high pressure fuel to the fuel injector 20 via the inlet 22.

At least a portion of the quill tube proximal component 300 at its proximal end may be inserted into the opening 202 in the quill nut 200, as shown in FIG. 2. In the exemplary embodiment, the quill nut 200 includes an inner surface 220 for engaging with an outer surface 310 of the quill tube proximal component 300, as will be described in more detail below, to detachably connect the quill nut 200 to the quill tube proximal component 300. The quill tube proximal component 300 may include a neck portion 304 and a shoulder portion 306 such that the neck portion 304 may be inserted into the opening 202 in the quill nut 200 until the shoulder portion 306 abuts the distal surface of the quill nut 200, as shown in FIG. 2.

The distal end of the quill tube proximal component 300 includes a receptor portion 308 that receives the proximal end of the quill tube distal component 400, as shown in FIG. 2. For example, in the exemplary embodiment, the receptor portion 308 includes an inner surface 320 for engaging with an outer surface 410 of the quill tube distal component 400, as will be described in more detail below, to detachably connect the quill tube proximal component 300 to the quill tube distal component 400.

The fuel delivery assembly 100 may also include one or more of a valve member 110, a spring 120, a filter 130, a locating projection 140, and a sealing member 150. The valve member 110, the spring 120, and/or the filter 130 may be disposed in one or both of the openings 302, 402 extending through the quill tube proximal and distal components 300, 400. In the exemplary embodiment shown in FIG. 2, valve member 110, the spring 120, and the filter 130 are disposed in the opening 402 in the quill tube distal component 400.

The valve member 110 may be a reverse flow check valve, and the spring 120 may act to bias the valve member 110 in the proximal direction against a surface of the quill tube proximal member 300. The filter 130 may assist in collecting debris, such as dirt or other contaminants, in the flow of fuel to prevent the debris from leaving the fuel delivery assembly 100 and entering the fuel injector 20, thereby preventing clogging of the fuel injector 20. The locating projection 140 may be received in a slot (not shown) in the cylinder head 12 to assist in preventing the quill tube proximal and distal components 300, 400 from rotating with respect to the cylinder head 12 and the fuel injector 20. Thus, the locating projection 140 may prevent the quill tube distal component 400 from damaging the inlet 22 in the fuel injector 20 at the outlet end 104. The sealing member 150 may be an o-ring or other seal for preventing fluid, such as low pressure fuel, surrounding the fuel delivery assembly 100 in the cylinder head 12 from leaking out of the bore in the cylinder head 12. The low pressure fuel may be provided, for example, to cool the fuel injector 20 and/or other components disposed in the cylinder head 12.

Figure 5:
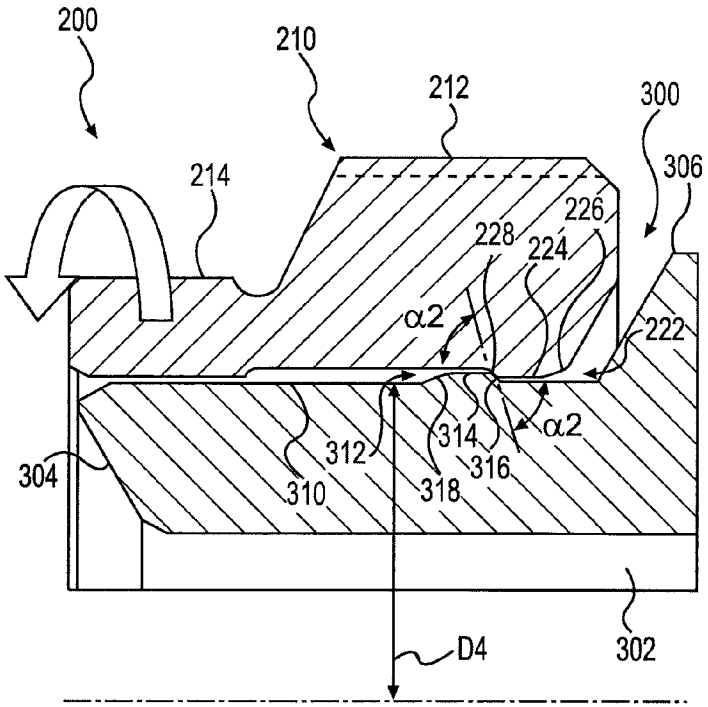
FIGS. 4 and 5 are cross sectional views of the connection between the quill nut and a quill tube of the fuel delivery assembly of FIG. 1.
Figure 4:
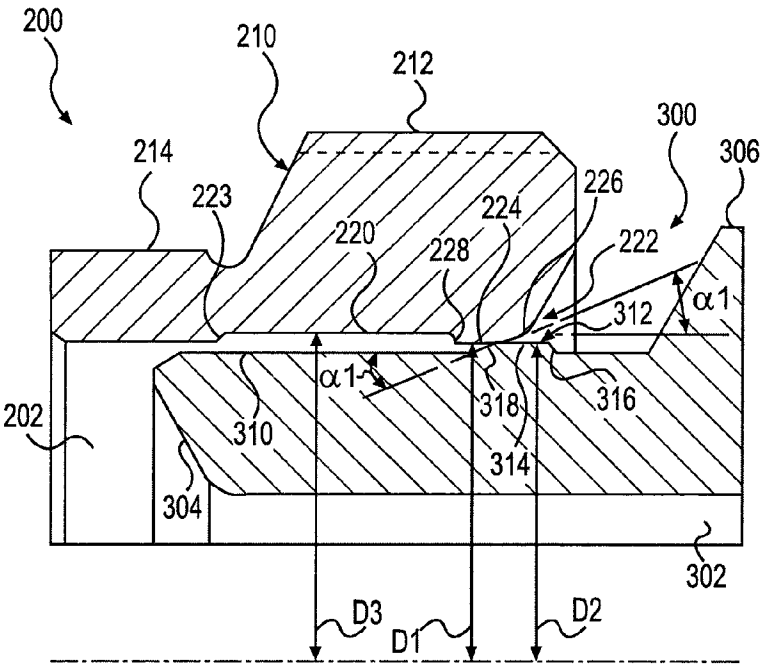
Figure 7:
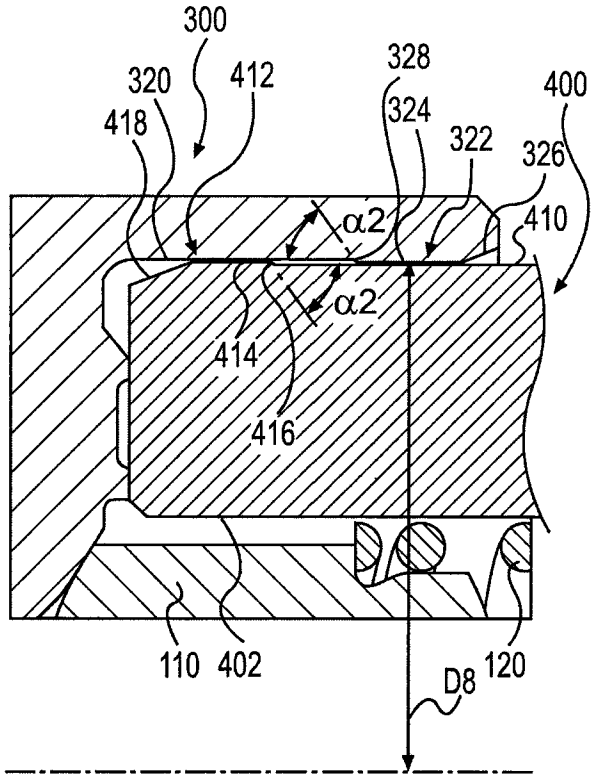
FIGS. 6 and 7 are cross sectional views of the connection between proximal and distal components of the quill tube of the fuel delivery assembly of FIG. 1.
Figure 6:
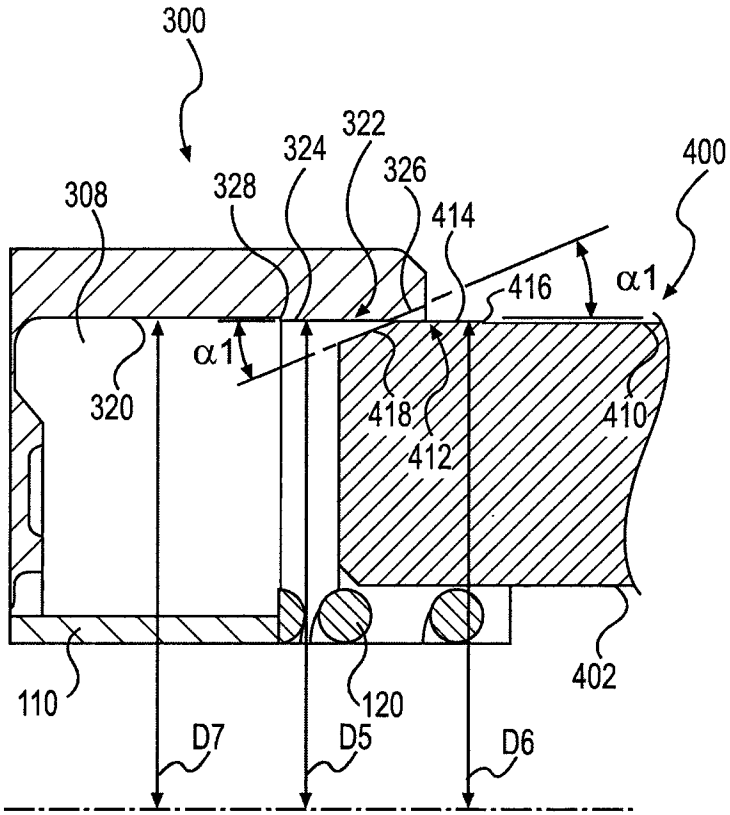

The connections between the quill nut 200, the quill tube proximal component 300, and the quill tube distal component 400 will now be described. FIGS. 4 and 5 show the movement of the quill tube proximal component 300 with respect to the quill nut 200. FIGS. 6 and 7 show the movement of the quill tube distal component 400 with respect to the quill tube proximal component 300.

As shown in FIGS. 4 and 5, the inner surface 220 of the quill nut 200 includes a projection 222. The projection 222 includes a distal edge 226, a proximal edge 228, and a surface 224 generally located a first distance D1 from a longitudinal axis of the quill nut 200. The distal edge 226 may be formed with an angle (e.g., angle $\alpha$1) with respect to the surface 224 (or the inner surface 220), and the proximal edge 228 may be formed with an angle (e.g., angle $\alpha 2$) with respect to the surface 224 (or the inner surface 220). The angle of the distal edge 226 may be a smaller angle than the angle of the proximal edge 228 (e.g., $\alpha 1<\alpha 2$). For example, angle $\alpha 2$ may be 15 degrees to 20 degrees, and angle $\alpha 2$ may be 45 degrees to 60 degrees.

The outer surface 310 of the quill tube proximal component 300 includes a projection 312. The projection 312 includes a distal edge 316, a proximal edge 318, and a surface 314 generally located a second distance D2 from a longitudinal axis of the quill tube proximal component 300. As shown in FIGS. 4 and 5, the longitudinal axes of the quill nut 200 and the quill tube proximal component 300 may be coincident. The distal edge 316 may be formed with an angle (e.g., angle $\alpha 2$) with respect to the surface 314 (or the outer surface 310), and the proximal edge 318 may be formed with an angle (e.g., angle $\alpha 1$) with respect to the surface 314 (or the outer surface 310). The angle of the distal edge 316 may be larger than the angle of the proximal edge 318 (e.g., $\alpha 2>\alpha 1$).

FIG. 4 shows the projections 222, 312 contacting and beginning to slide past each other to engage in an interference or press fit during insertion of the quill tube proximal component 300 into the quill nut 200. The first distance D1 of the projection 222 may be less than the second distance D2 of the projection 312. If the first distance D1 is less than the second distance D2, then the projections 222, 312 engage in an interference fit as they slide past each other. The first and second distances D1, D2 and/or the materials for forming the respective components may be selected to ensure that the respective components do not plastically deform when the projections 222, 312 slide past each other.

Also, if the angles of the respective edges of the projections 222, 312 that contact each other when the quill tube proximal component 300 is inserted into the quill nut 200 (e.g., the distal edge 226 and the proximal edge 318) are relatively small (e.g., angle $\alpha 1$), then pressing the projection 312 past the projection 222 may be easier and damage to the respective components may be minimized. If the angles of the opposite edges of the projections 222, 312 (e.g., the proximal edge 228 and the distal edge 316) are relatively large (e.g., angle $\alpha 2$), then sliding the projections 222, 312 past each other in the opposite direction (i.e., in the direction of removing the quill tube proximal component 300 from the quill nut 200) may be more difficult. Accordingly, the projections 222, 312 may be formed to provide greater resistance to removing the quill tube proximal component 300 from the quill nut 200 than to inserting the quill tube proximal component 300 into the quill nut 200. As a result, connecting and retaining the components together is facilitated, and unintentional separation may be prevented.

FIG. 5 shows the projections 222, 312 in contact after the projections 222, 312 have moved past each other. The inner surface 220 of the quill nut 200 is generally located a third distance D3 from the longitudinal axis of the quill nut 200, and the outer surface 310 of the quill tube proximal component 300 is generally located a fourth distance D4 from the longitudinal axis of the quill tube proximal component 300. The third distance D3 may be greater than the second distance D2 and the fourth distance D4 so that the quill tube proximal component 300 is free to move axially after the projections 222, 312 have moved past each other. The projection 312 is free to move axially within a clearance bore defined by the inner surface 220 between the projection 222 and a terminating portion 223 located proximal to the projection 222 on the inner surface 210 of the quill nut 200. The projection 312 is free to move axially within the clearance bore past the projection 222 until the shoulder portion 306 abuts the distal surface of the quill nut 200, as shown in FIG. 2. This ability to move axially allows the quill nut 200 to rotate with respect to the quill tube proximal component 300, e.g., when connecting the quill nut 200 to the cylinder head 12.

With respect to the movement of the quill tube distal component 400 with respect to the quill tube proximal component 300, as shown in FIGS. 6 and 7, the inner surface 320 of the quill tube proximal component 300 includes a projection 322. The projection 322 includes a distal edge 326, a proximal edge 328, and a surface 324 generally located a fifth distance D5 from the longitudinal axis of the quill tube proximal component 300. As shown in FIG. 6, the distal edge 326 may extend to the distal surface of the quill tube proximal component 300. The distal edge 326 may be formed with an angle (e.g., angle $\alpha 1$) with respect to the surface 324 (or the inner surface 320), and the proximal edge 328 may be formed with an angle (e.g., angle $\alpha 2$) with respect to the surface 324 (or the inner surface 320). The angle of the distal edge 326 may be a smaller angle than the angle of the proximal edge 328 (e.g., $\alpha 1<\alpha 2$).

The outer surface 410 of the quill tube distal component 400 includes a projection 412. The projection 412 includes a distal edge 416, a proximal edge 418, and a surface 414 generally located a sixth distance D6 from a longitudinal axis of the quill tube distal component 400. As shown in FIGS. 6 and 7, the proximal edge 418 may extend to the proximal surface of the quill tube distal component 400, and the longitudinal axes of the quill tube proximal component 300 and the quill tube distal component 400 may be coincident. The distal edge 416 may be formed with an angle (e.g., angle $\alpha 2$) with respect to the surface 414 (or the outer surface 410), and the proximal edge 418 may be formed with an angle (e.g., angle $\alpha 1$) with respect to the surface 414 (or the outer surface 410). The angle of the distal edge 416 may be larger than the angle of the proximal edge 418 (e.g., $\alpha 2>\alpha 1$).

FIG. 6 shows the projections 322, 412 contacting and beginning to slide past each other to engage in an interference or press fit during insertion of the quill tube distal component 400 into the quill tube proximal component 300. The fifth distance D5 of the projection 322 may be less than the sixth distance D6 of the projection 412. If the fifth distance D5 is less than the sixth distance D6, then the projections 322, 412 engage in an interference fit as they slide past each other. The fifth and sixth distances D5, D6 and/or the materials for forming the respective components may be selected to ensure that the respective components do not plastically deform when the projections 322, 412 slide past each other.

Also, if the angles of the respective edges of the projections 322, 412 that contact each other when the quill tube distal component 400 is inserted into the quill tube proximal component 300 (e.g., the distal edge 326 and the proximal edge 418) are relatively small (e.g., angle $\alpha 1$), then pressing the projection 412 past the projection 322 may be easier and damage to the respective components may be minimized. If the angles of the opposite edges of the projections 322, 412 (e.g., the proximal edge 328 and the distal edge 416) are relatively large (e.g., angle $\alpha 2$), then sliding the projections 322, 412 past each other in the opposite direction (e.g., in the direction of removing the quill tube distal component 400 from the quill tube proximal component 300) may be more difficult. Accordingly, the projections 322, 412 may be formed to provide greater resistance to removing the quill tube distal component 400 from the quill tube proximal component 300 than to inserting the quill tube distal component 400 into the quill tube proximal component 300. As a result, connecting and retaining the components together is facilitated, and unintentional separation may be prevented.

FIG. 7 shows the projections 322, 412 after the projections 322, 412 have moved past each other. The inner surface 320 of the quill tube proximal component 300 is generally located a seventh distance D7 from the longitudinal axis of the quill tube proximal component 300, and the outer surface 410 of the quill tube distal component 400 is generally located an eighth distance D8 from the longitudinal axis of the quill tube distal component 400. The seventh distance D7 may be greater than the sixth distance D6 and the eighth distance D8 so that the quill tube distal component 400 is free to move axially after the projections 322, 412 have moved past each other. The projection 412 is free to move axially after sliding past the projection 322 until the distal surface of the quill tube distal component 400 abuts the quill tube proximal component 300, as shown in FIG. 7.

The projections 222, 312, 322, 412 may extend around a majority of or substantially the entire circumference of the respective surfaces of the quill nut 200, the quill tube proximal component 300, and the quill tube distal component 400.

According to an alternative embodiment, instead of inserting the proximal end of the quill tube distal component 400 into the quill tube proximal component 300, the distal end of the quill tube proximal component 300 may be inserted into the proximal end of the quill tube distal component 400. For example, the proximal end of the quill tube distal component 400 may include a receptor portion (similar to the receptor portion 308) having an inner surface formed with a projection, and the quill tube proximal component 300 may include an outer surface with a projection. The two projections may engage in an interference fit in a similar manner as described above when the quill tube proximal component 300 is inserted into the quill tube distal component 400.

Figure 8:
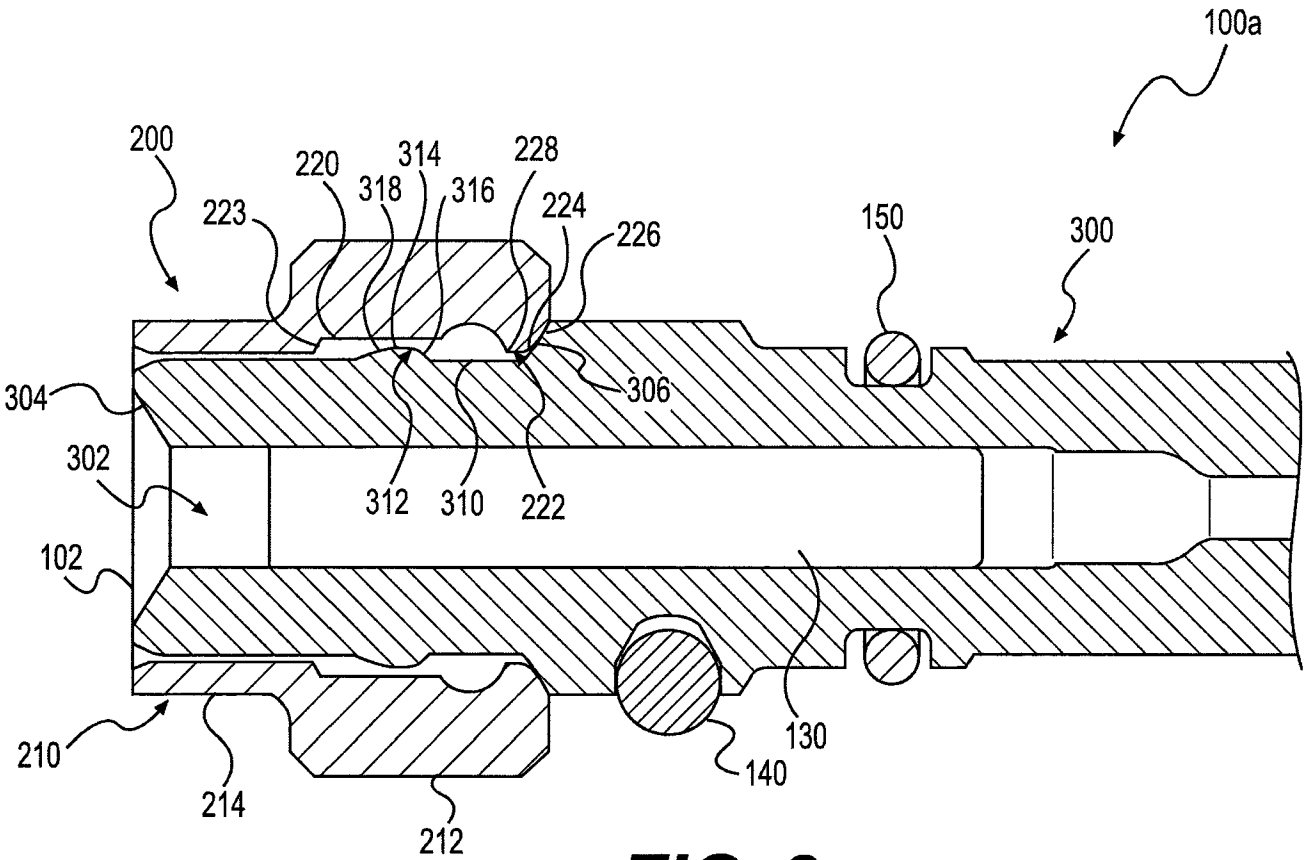
FIG. 8 is a cross sectional view of a fuel delivery assembly according to another exemplary embodiment.

FIG. 8 shows an exemplary embodiment of the fuel delivery assembly 100*a* having the same features as the fuel delivery assembly 100 described above except that the projections 222, 312 are rounded instead of flat, and a portion of the inner surface 220 of the quill nut 200 is rounded. The relative dimensions (distances D1-D4 and angles $\alpha 1$, $\alpha 2$) of the quill nut 200 and the quill tube proximal component 300 (including the projections 222, 312) may be the same as described above in connection with FIGS. 4 and 5. For example, the distal edge 226 may be formed having an angle (e.g., angle $\alpha 1$) with respect to the surface 224 (or the inner surface 220), and the proximal edge 228 may be formed having an angle (e.g., angle $\alpha 2$) with respect to the surface 224 (or the inner surface 220), where $\alpha 1 < \alpha 2$. The surface 224 may be generally located the first distance D1 from the longitudinal axis of the quill nut 200, and the surface 314 may be generally located the second distance D2 from the longitudinal axis of the quill tube proximal component 300, where D1<D2.

INDUSTRIAL APPLICABILITY

The disclosed fuel delivery assembly 100 may be applicable to any engine that includes a fuel injector. The disclosed fuel delivery assembly 100 may be easier to assemble and extract from a bore in the cylinder head 12 of the engine 10, and may be configured so that the entire fuel delivery assembly 100 or substantially the entire fuel delivery assembly 100 is recessed into the cylinder head 12. The disclosed fuel delivery assembly may also be smaller and more compact.

To assemble the fuel delivery assembly 100, various components, such as the valve member 110, the spring 120, and the filter 130, may be inserted into the opening 402 in the quill tube distal component 400 before connecting the quill tube proximal and distal components 300, 400 together. As a result, since the quill tube may be formed in separate components, e.g., the quill tube proximal and distal components 300, 400, that are detachably connected, the quill tube may be easily assembled with the valve member 110, the spring 120, and/or the filter 130 provided inside, and the valve member 110, the spring 120, and/or the filter 130 may be replaceable.

Next, the quill tube distal component 400 may be detachably connected to the quill tube proximal component 300, as shown in FIGS. 6 and 7 and as described above. The projections 322, 412 may engage in an interference or press fit when the components 300, 400 are connected together or separated. Also, the quill nut 200 may be detachably connected to the quill tube proximal component 300, as shown in FIGS. 4 and 5 and as described above. The projections 222, 312 may engage in an interference or press fit when the quill nut 200 and the quill tube proximal component 300 are connected together or separated. The projections 222, 312, 322, 412 allow the quill nut 200 and the quill tube components 300, 400 to be easier to connect together and detach, without any additional components (e.g., a component crimped or otherwise connected to the components 300, 400) for securing the quill nut 200 and the quill tube components 300, 400 together. Thus, the projections 222, 312, 322, 412 provide a reliable connection without requiring an increase in size of the fuel delivery assembly 100 or an increase in size of the bore in the cylinder head 12 that receives the fuel delivery assembly 100, thereby allowing the fuel delivery assembly 100 to be relatively thin-walled and allowing the size of the bore in the cylinder head 12 to be more compact. This may also reduce the cost of manufacturing the fuel delivery assembly 100.

When connected to the quill nut 200, the quill tube proximal component 300 may be movable in the axial direction with respect to the quill nut 200. The axial movement of the quill tube proximal component 300 may be limited proximally when the shoulder portion 306 abuts the distal surface of the quill nut 200, as shown in FIG. 2, and may be limited distally when the projection 312 contacts the projection 222 in the quill nut 200. The limited range of axial movement may facilitate removal of the quill nut 200 from the quill tube proximal component 300 and/or retention of the quill nut 200 on the quill tube proximal component 300, e.g., by allowing the quill nut 200 to rotate with respect to the quill tube proximal component 300 when the quill nut 200 is unscrewed from the cylinder head 12.

Then, with the quill nut 200 and the quill tube components 300, 400 connected together to form the fuel delivery assembly 100, the fuel delivery assembly 100 may be inserted into the cylinder head 12. The fuel delivery assembly 100 may be inserted by holding the gripping portion 214 of the quill nut 200 (e.g., by hand or with a tool), sliding the fuel delivery assembly 100 into the cylinder head 12, and engaging the threaded portion 212 of the quill nut 200 with the threaded surface 14 in the cylinder head 12. The cylinder head 12 may be configured so that the user may screw the quill nut 200 into the cylinder head 12 until the outlet end 104 of the fuel delivery assembly 100 contacts and is received by the inlet 22 in the fuel injector 20. As a result, the entire quill tube may be inserted into the cylinder head 12 so that the quill tube (e.g., the quill tube proximal and distal components 300, 400) does not extend out of the cylinder head 12. This may be advantageous in certain applications, such as marine applications (e.g., ocean vessels, petroleum drilling rigs, etc.) or other applications for which additional shielding is necessary for high pressure fuel connections. For example, additional shielding (e.g., double wall shielding) may be used to protect the connections of the components through which high pressure fuel flows so that fuel does not leak through the high pressure connections. In the exemplary embodiment, since the entire fuel delivery assembly 100 may be recessed in the cylinder head 12, the cylinder head 12 may act as shielding for protecting the fuel delivery assembly 100. There is no need for additional shielding for protecting the fuel delivery assembly 100 if the fuel delivery assembly 100 extended out of the cylinder head 12.

Next, the fuel line connector 32 may be screwed directly into the cylinder head 12 proximal to the quill nut 200. The fuel line connector 32 includes a threaded surface that engages with the same threaded surface 14 in the cylinder head 12 used to engage with the threaded portion 212 of the quill nut 200. The fuel line connector 32 may be screwed into the cylinder head 12 until the fuel line 30 abuts the inlet end 102 of the fuel delivery assembly 100, as shown in FIG. 1. In this position, the fuel line 30 may direct the high pressure fuel through the openings 302, 402 in the fuel delivery assembly 100, which may then direct the high pressure fuel to the inlet 22 in the fuel injector 20. As a result, the fuel line connector 32 may also act as shielding for protecting the quill nut 200 and the quill tube components 300, 400.

In the exemplary embodiment, the valve member 110 may be disposed within the fuel delivery assembly 100 to control the flow of the high pressure fuel. Without the valve member 110, a pressure wave may be produced by the fuel injector 20 when the flow of fuel stops (e.g., between fuel injections by the fuel injector 20), and the pressure wave may propagate between the common rail, the fuel line 30, the fuel delivery assembly 100, and the fuel injector 20. The pressure wave may affect the fuel pressures of the fuel injections. When the fuel delivery assembly 100 includes the valve member 110, the valve member 110 may act as a damper that reduces the pressure waves, and allows the fuel injector 20 to inject fuel at a more stable, constant pressure. Thus, the valve member 100 may reduce or prevent the pressure waves from affecting the fuel pressure of the fuel injections by the fuel injector 20.

The fuel delivery assembly 100 may be easier to extract from the cylinder head 12, for example, to replace the fuel delivery assembly 100. To extract the fuel delivery assembly 100 from the cylinder head 12, the fuel line connector 32 and the quill nut 200 may be unscrewed from the cylinder head 12 (e.g., using a tool or by hand). As the quill nut 200 is unscrewed from the cylinder head 12, as shown in FIG. 5, the quill nut 200 backs out of the cylinder head 12 until the proximal edge 228 of the projection 222 on the quill nut 200 contacts the distal edge 316 of the projection 312 on the quill tube proximal component 300 without allowing the projections 222, 312 to slide past each other to unintentionally separate the quill nut 200 from the quill tube proximal component 300. Thus, the projections 222, 312 may be configured to provide a strong enough connection that allows the quill nut 200 to pull the connected quill tube proximal and distal components 300, 400 out of the cylinder head 12, and to overcome any forces compressing the sealing member 150 against the cylinder head 12. As a result, the fuel delivery assembly 100, and more specifically the quill tube components 300, 400, may be easier to remove from the cylinder head 12 simply by unscrewing and extracting the quill nut 200 from the cylinder head 12, without requiring additional tools (e.g., other than a socket) that may damage or contaminate the fuel delivery assembly 100.

Since the projections 222, 312, 322, 412 may be integrally formed in the respective quill nut 200 and quill tube proximal or distal components 300, 400, the projections 222, 312, 322, 412 may serve as built-in features that detachably connect the quill nut 200, and the quill tube proximal and distal components 300, 400 together while also allowing for the removal of the entire fuel delivery assembly 100 from the cylinder head 12 when the entire fuel delivery assembly 100 is recessed in the cylinder head 12.

As described above, the distal and proximal edges of the projections 222, 312, 322, 412 may be formed with certain angles (e.g., $\alpha 1$ or $\alpha 2$, where $\alpha 1<\alpha 2$) so that more force is needed to separate the connected components (e.g., the connected quill nut 200 and quill tube proximal component 300, or the connected quill tube proximal and distal components 300, 400) than to connect the components together. As a result, connecting the components may be facilitated, and damage to the components during connection may be minimized. Also, the connected components may be held together and the components may be harder to unintentionally separate while the fuel delivery assembly 100 is removed from the cylinder head 12.

It will be apparent to those skilled in the art that various modifications and variations can be made to the fuel delivery assembly. Other embodiments will be apparent to those skilled in the art from consideration of the specification and practice of the disclosed fuel delivery assembly. It is intended that the specification and examples be considered as exemplary only, with a true scope being indicated by the following claims and their equivalents.

What is claimed is:

1. A fuel delivery assembly for delivering a flow of fuel to a fuel injector, the fuel delivery assembly comprising:

a securing member including a securing member opening extending through the securing member such that the securing member is generally cylindrical, the securing member opening including an inner surface that includes a securing member projection; and a quill tube including a quill tube opening extending through the quill tube such that the quill tube is generally cylindrical, the quill tube opening being configured to receive the flow of fuel and direct the flow of fuel to the fuel injector, the quill tube including an outer surface that includes a quill tube projection, wherein the securing member opening is configured to receive at least a portion of the quill tube, and the securing member projection and the quill tube projection are configured to engage in an interference fit, wherein the quill tube includes a first subcomponent detachably connected to a second subcomponent, wherein the first and second subcomponents each include an opening extending through the respective subcomponent such that the first and second subcomponents are generally cylindrical and such that the first and second subcomponent openings form the quill tube opening, wherein the first subcomponent opening is configured to receive at least a portion of the second subcomponent, wherein the first subcomponent includes an inner surface that includes a first subcomponent projection, wherein the second subcomponent includes an outer surface that includes a second subcomponent projection, and wherein the first and second subcomponent projections are configured to engage in an interference fit.

2. The fuel delivery assembly of claim 1, wherein the securing member is rotatable with respect to the quill tube when the quill tube is disposed in the securing member after engaging in the interference fit.

3. The fuel delivery assembly of claim 1, wherein:

the quill tube is movable in an axial direction with respect to the securing member when the quill tube is disposed in the securing member after engaging in the interference fit; and the securing member projection and the quill tube projection are configured to limit axial movement of the quill tube with respect to the securing member when the quill tube is disposed in the securing member opening.

4. The fuel delivery assembly of claim 1, wherein the securing member includes an outer surface configured to attach to a surface in a cylinder head of an engine.

5. The fuel delivery assembly of claim 4, wherein the outer surface of the securing member further includes a surface configured to be gripped by a tool and located proximal to the surface configured to attach to the cylinder head.

6. The fuel delivery assembly of claim 1, wherein:

the securing member projection includes a surface generally located a first distance from a longitudinal axis of the securing member;

the quill tube projection includes a surface generally located a second distance from a longitudinal axis of the quill tube;

the first distance is less than the second distance such that the securing member projection and the quill tube projection are configured to engage in the interference fit.

7. The fuel delivery assembly of claim 1, wherein at least one of the securing member projection or the quill tube projection is configured to provide greater resistance to removing the quill tube from the securing member than to inserting the quill tube into the securing member.

8. The fuel delivery assembly of claim 7, wherein at least one of the securing member projection or the quill tube projection includes a first edge and a second edge, the first edge being formed with a smaller angle than the second edge such that the at least one securing member projection or quill tube projection is configured to provide greater resistance to removing the quill tube from the securing member than to inserting the quill tube into the securing member.

9. The fuel delivery assembly of claim 8, wherein the first edge is formed with an angle within a range of 15 degrees to 20 degrees, and the second edge is formed with an angle within a range of 45 degrees to 60 degrees.

10. The fuel delivery assembly of claim 1, further including a valve member disposed in the quill tube opening and between the first and second subcomponents.

11. The fuel delivery assembly of claim 1, wherein:

the second subcomponent is movable in an axial direction with respect to the first subcomponent when the second subcomponent is disposed in the first subcomponent opening and after engaging in the interference fit; and the first and second subcomponent projections limit axial movement of the second subcomponent with respect to the first subcomponent when the second subcomponent is disposed in the first subcomponent.

12. The fuel delivery assembly of claim 1, wherein longitudinal axes of the securing member and the quill tube are substantially coincident.

13. A method of assembling a fuel delivery assembly for an engine, the method comprising:

detachably connecting a first subcomponent to a second subcomponent to form a fuel delivery component, a valve member being disposed between the first and second subcomponents, the first and second subcomponents and the valve member being configured to receive a flow of fuel, the first subcomponent being detachably connected to the second subcomponent with an interference fit;

allowing the second subcomponent to move axially within a limited range of movement with respect to the first subcomponent when the second subcomponent is connected to the first subcomponent;

detachably connecting a securing member to the fuel delivery component with an interference fit;

inserting at least a portion of the connected securing member and the fuel delivery component into a bore in a cylinder head of the engine; and detachably connecting the securing member to an inner surface of the bore.

14. The method of claim 13, further comprising allowing the fuel delivery component to move axially within a limited range of movement with respect to the securing member when the fuel delivery component is connected to the securing member.

15. An engine comprising:

a cylinder head including a bore, the bore including an inner surface;

a generally cylindrical securing member including an outer surface configured to be detachably connected to the inner surface of the bore; and a fuel delivery component including an opening extending through the fuel delivery component such that the fuel delivery component is generally cylindrical, the opening being configured to receive a flow of fuel, the securing member being detachably connected to the fuel delivery component, the securing member and the fuel delivery component being configured to be inserted into the bore in the cylinder head such that the entire fuel delivery component is located in the bore when the outer surface of the securing member is connected to the inner surface of the bore; and a fuel injector disposed inside the cylinder head and configured to receive the flow of fuel from the fuel delivery component, wherein the quill tube includes a first subcomponent detachably connected to a second subcomponent, wherein the first and second subcomponents each include an opening extending through the respective subcomponent such that the first and second subcomponents are generally cylindrical and such that the first and second subcomponent openings form the quill tube opening, wherein the first subcomponent opening is configured to receive at least a portion of the second subcomponent, wherein the first subcomponent includes an inner surface that includes a first subcomponent projection, wherein the second subcomponent includes an outer surface that includes a second subcomponent projection, and wherein the first and second subcomponent projections are configured to engage in an interference fit.

16. The engine of claim 15, wherein the bore of the cylinder head includes a first threaded surface configured to engage a second threaded surface on the outer surface of the securing member and to engage a third threaded surface of a connector of a fuel line configured to supply the flow of fuel to the fuel delivery component.

17. The engine of claim 15, wherein:

the securing member includes an inner surface that includes a first projection;

the fuel delivery component includes an outer surface that includes a second projection; and the first and second projections are configured to engage in an interference fit to assist in removal of the fuel delivery component from the cylinder head.

* * * * *

UNITED STATES PATENT AND TRADEMARK OFFICE

CERTIFICATE OF CORRECTION

PATENT NO. : 8,596,247 B2
APPLICATION NO. : 12/835144
DATED : December 3, 2013
INVENTOR(S) : Tower et al.

It is certified that error appears in the above-identified patent and that said Letters Patent is hereby corrected as shown below:

In the Specification

Column 5, line 4, delete "angle α2" and insert -- angle α1 --.

Signed and Sealed this
Eighteenth Day of August, 2015

Michelle K. Lee

Michelle K. Lee
*Director of the United States Patent and Trademark Office*